US011499691B1

(12) United States Patent
Lee et al.

(10) Patent No.: US 11,499,691 B1
(45) Date of Patent: Nov. 15, 2022

(54) LAMP FOR VEHICLE

(71) Applicant: SL Corporation, Daegu (KR)

(72) Inventors: Jeong Su Lee, Gyeongsan-si (KR); Jong Woon Kim, Gyeongsan-si (KR); Nak Jung Choi, Gyeongsan-si (KR)

(73) Assignee: SL Corporation, Daegu (KR)

( * ) Notice: Subject to any disclaimer, the term of this patent is extended or adjusted under 35 U.S.C. 154(b) by 0 days.

(21) Appl. No.: 17/690,353

(22) Filed: Mar. 9, 2022

(30) Foreign Application Priority Data

May 13, 2021 (KR) ..... 10-2021-0061976

(51) Int. Cl.
*F21S 41/265* (2018.01)
*F21S 41/27* (2018.01)
*F21S 41/40* (2018.01)

(52) U.S. Cl.
CPC ..... *F21S 41/265* (2018.01); *F21S 41/27* (2018.01); *F21S 41/40* (2018.01)

(58) Field of Classification Search
CPC ..... F21S 41/265; F21S 41/141; F21S 41/143; F21S 41/151; F21S 41/153; F21V 5/004; F21V 5/007
See application file for complete search history.

(56) References Cited

U.S. PATENT DOCUMENTS

2019/0032881 A1* 1/2019 Kim ..... F21S 41/285

* cited by examiner

*Primary Examiner* — Sean P Gramling
(74) *Attorney, Agent, or Firm* — United One Law Group LLC; Kongsik Kim; Jhongwoo Peck

(57) ABSTRACT

A vehicle lamp includes a light source unit for generating light, and a lens unit including a plurality of incident lenses, to which the light generated from the light source unit is incident, a plurality of emitting lenses for emitting the light incident from the plurality of incident lenses, and a plurality of shields for obstructing at least a portion of the light incident to each of the plurality of emitting lenses. Each of the plurality of shields includes a transmission region for transmitting light and a blocking region for obstructing light, and at least one light shielding member for obstructing a portion of the light through the transmission region is formed in the transmission region of at least one of the plurality of shields.

10 Claims, 15 Drawing Sheets

LAMP FOR VEHICLE

CROSS-REFERENCE TO RELATED APPLICATION

This application claims priority from Korean Application No. 10-2021-0061976 filed on May 13, 2021, which application is incorporated herein by reference in its entirety.

BACKGROUND

1. Technical Field

The present disclosure relates to a vehicle lamp, and more particularly, to a vehicle lamp capable of forming a pattern image having various brightness patterns.

2. Description of the Related Art

A vehicle is provided with various types of lamps having an illumination function for easily identifying an object located around the vehicle in low light conditions (e.g., night-time driving) and a signaling function for notifying drivers of other vehicles or pedestrians of the driving state of the vehicle.

For example, head lamps and fog lamps are mainly for the illumination functions, and turn signal lamps, tail lamps, and brake lamps are mainly for signaling functions. The installation standards and specifications of each lamp are stipulated by law or regulations to ensure that the functions of each lamp are fully implemented.

Recently, research has been actively conducted to reduce the size of the lamp by using micro lenses having a relatively short focal length. In this case, a pattern image having a required shape or size is formed by the light emitted from the micro lens through a shield that obstructs a portion of the light proceeding to the plurality of micro lenses.

Since the brightness of the pattern image formed by the light emitted from the micro lens is determined by the light amount of the light source, it is difficult to form a pattern image of various brightness. Therefore, there is a demand for a means to form a pattern image having more various brightness patterns.

SUMMARY

An object of the present disclosure is to provide a lamp for a vehicle that obstructs a portion of light that transmits through a transmission region of a shield so that a pattern image formed by the light that transmits through the shield can have various brightness patterns. The objects of the present disclosure are not limited to the objects mentioned above, and other objects not mentioned will be clearly understood by those skilled in the art from the following description.

According to an aspect of the present disclosure, a lamp for a vehicle may include a light source unit for generating light; and a lens unit including a plurality of incident lenses, to which the light generated from the light source unit is incident, a plurality of emitting lenses for emitting the light incident from the plurality of incident lenses, and a plurality of shields for obstructing at least a portion of the light incident to each of the plurality of emitting lenses. Each of the plurality of shields may include a transmission region for transmitting light and a blocking region for obstructing light, and at least one light shielding member for obstructing a portion of the light through the transmission region may be formed in the transmission region of at least one of the plurality of shields.

The light source unit may comprise at least one light source; and a light transferring unit for converting the light generated from the at least one light source into substantially parallel light and transferring it to the lens unit.

The lens unit may further comprise a first optical member, in which the plurality of incident lenses are formed on an incident surface thereof; and a second optical member, in which the plurality of emitting lenses are formed on an emitting surface thereof. The plurality of shields may be formed in at least one of the first optical member or the second optical member.

The at least one light shielding member may comprise a plurality of light shielding members formed in the transmission region. The plurality of light shielding members may be formed to have non-uniform distribution densities across the transmission region. For example, the plurality of light shielding members may be formed so that a distribution density is changed from a first side of the transmission region to a second side of the transmission region.

The lens unit may be divided into a central region and a peripheral region around the central region. Further, the at least one light shielding member may be formed in a shield disposed in a region corresponding to the central region of the lens unit among the plurality of shields.

The at least one light shielding member may decrease amount of light that transmits through at least some region of the transmission region to allow different regions of a pattern image formed on a road surface around the vehicle to exhibit different brightness by light transmitting through the transmission region. In some exemplary embodiments, the at least one light shielding member may decrease amount of light that transmits through at least some region of the transmission region to allow a pattern image formed on a road surface around the vehicle to exhibit substantially uniform brightness by light transmitting through the transmission region.

The transmission region may comprise a plurality of sub transmission regions, and the at least one light shielding member formed in at least one of the plurality of sub transmission regions may have a different distribution density from other light shielding members formed in other sub transmission regions. In some exemplary embodiments, the at least one light shield unit formed in at least one sub transmission region among the plurality of sub transmission regions may have non-uniform distribution densities across the at least one sub transmission region.

According to the exemplary embodiments of the vehicle lamp of the present disclosure as described above, there are one or more of the following effects. The brightness pattern of the pattern image may be more easily adjusted by varying the amount of light that transmits through different positions in the transmission region through the light shielding member formed in the transmission region of the shield without using a separate optical system to vary the brightness pattern of the pattern image. Therefore, the configuration may be simplified, and more diverse brightness patterns may be implemented. Effects of the present disclosure are not limited to the effects mentioned above, and other effects not mentioned will be clearly understood by those skilled in the art from the description set forth.

BRIEF DESCRIPTION OF THE DRAWINGS

These and/or other aspects will become apparent and more readily appreciated from the following description of the exemplary embodiments, taken in conjunction with the accompanying drawings in which.

DETAILED DESCRIPTION

Figure 1:
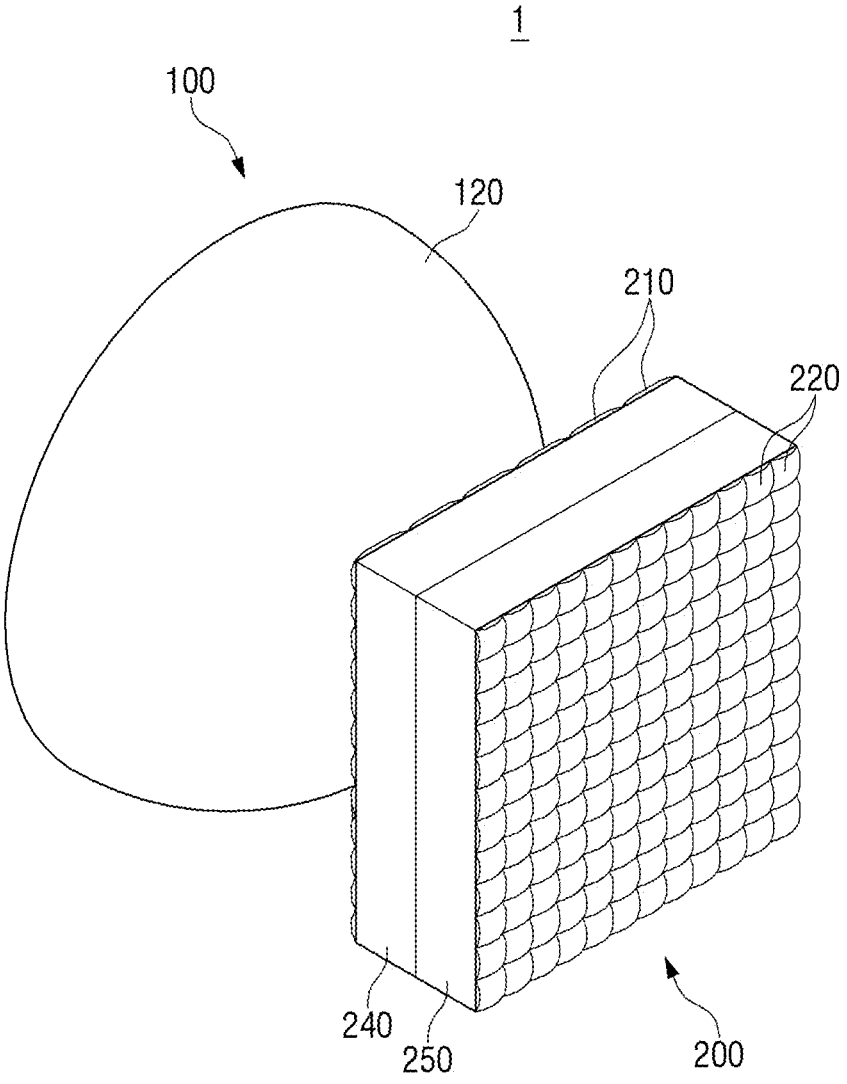
FIGS. 1 and 2 are perspective views showing a vehicle lamp according to an exemplary embodiment of the present disclosure.

Advantages and features of the present disclosure and methods of accomplishing the same may be understood more readily by reference to the following detailed description of exemplary embodiments and the accompanying drawings. The present disclosure may, however, be embodied in many different forms and should not be construed as being limited to the exemplary embodiments set forth herein. Rather, these exemplary embodiments are provided so that this disclosure will be thorough and complete and will fully convey the concept of the disclosure to those skilled in the art, and the present disclosure will only be defined by the appended claims. Throughout the specification, like reference numerals in the drawings denote like elements.

In some exemplary embodiments, well-known steps, structures and techniques will not be described in detail to avoid obscuring the disclosure.

The terminology used herein is for the purpose of describing particular exemplary embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Exemplary embodiments of the disclosure are described herein with reference to plan and cross-section illustrations that are schematic illustrations of idealized exemplary embodiments of the disclosure. As such, variations from the shapes of the illustrations as a result, for example, of manufacturing techniques and/or tolerances, are to be expected. Thus, exemplary embodiments of the disclosure should not be construed as limited to the particular shapes of regions illustrated herein but are to include deviations in shapes that result, for example, from manufacturing. In the drawings, respective components may be enlarged or reduced in size for convenience of explanation.

Hereinafter, the present disclosure will be described with reference to the drawings for describing a vehicle lamp according to exemplary embodiments of the present disclosure.

Figure 2:
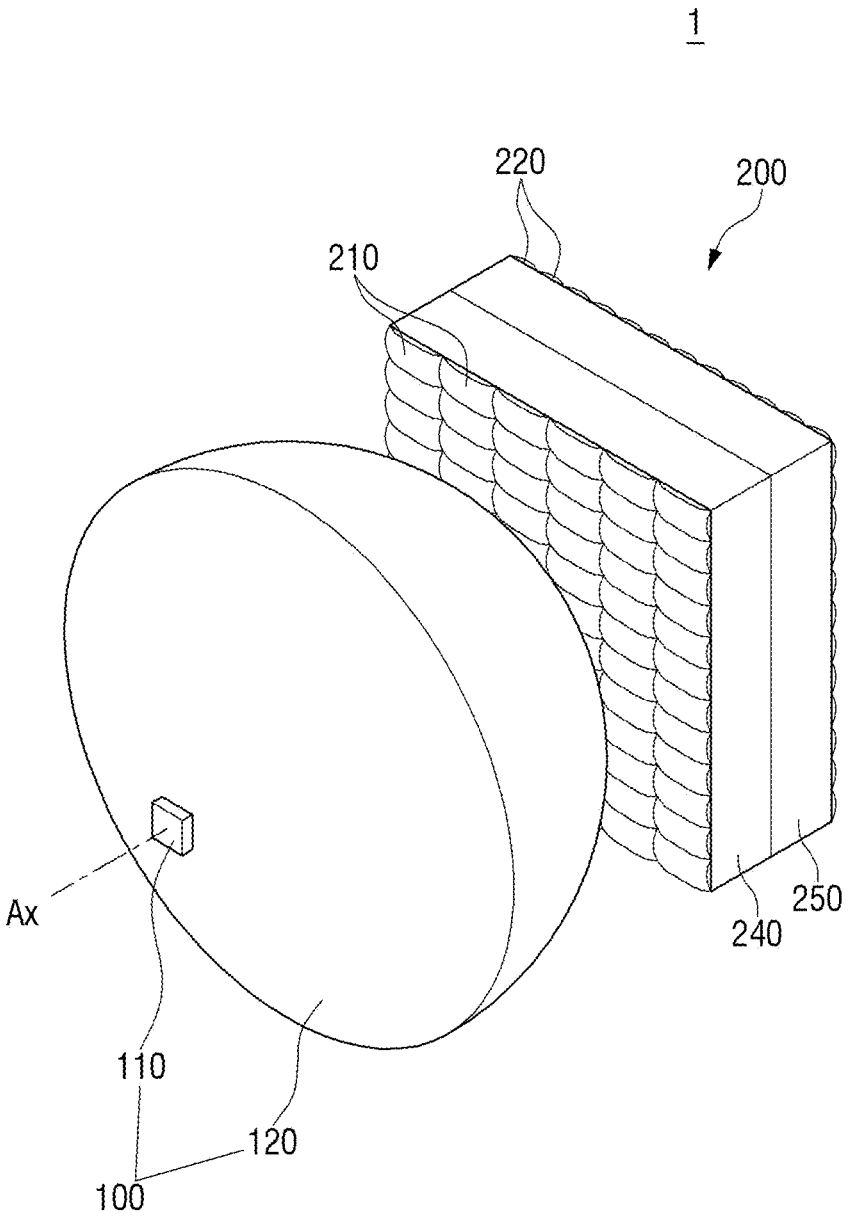
Figure 3:
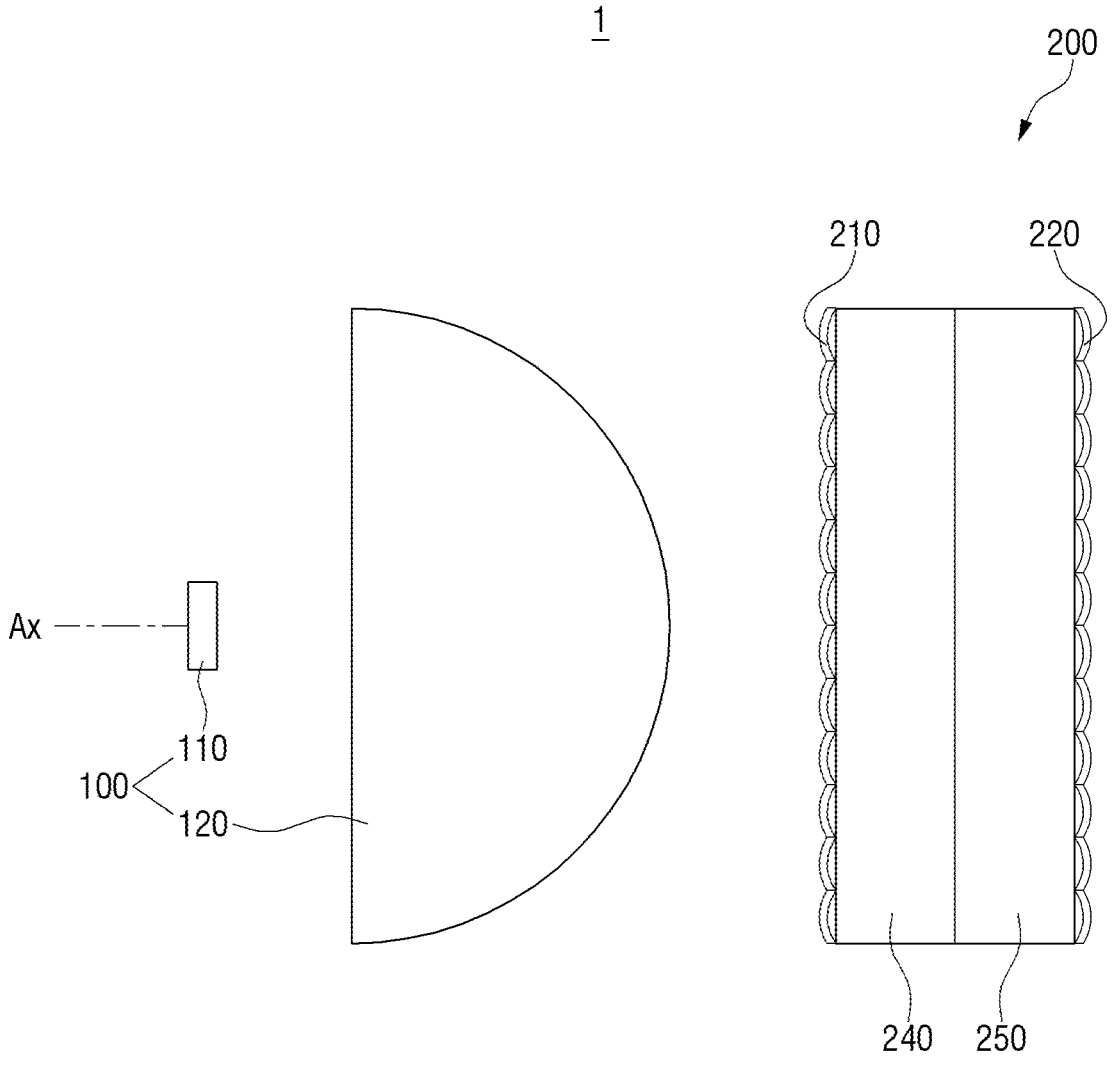
FIG. 3 is a side view showing a vehicle lamp according to an exemplary embodiment of the present disclosure.

FIGS. 1 and 2 are perspective views illustrating a vehicle lamp according to an exemplary embodiment of the present disclosure, and FIG. 3 is a side view illustrating a vehicle lamp according to an exemplary embodiment of the present disclosure.

Referring to FIGS. 1 to 3, the vehicle lamp 1 according to the exemplary embodiment of the present disclosure may include a light source unit 100 and a lens unit 200. The light source unit 100 and the lens unit 200 may be disposed in a space formed by a lamp housing (not shown) and a cover lens (not shown) coupled to the lamp housing and for irradiating light to the outside of the vehicle.

In the exemplary embodiment of the present disclosure, the vehicle lamp 1 may be used for various functions including an illumination function such as a head lamp to ensure the driver's view when the vehicle is operating in low light conditions (e.g., at night), a signaling function such as a position lamp, a daytime running lamp (DRL), a turn signal lamp, and a brake lamp that inform surrounding vehicles or pedestrians of the driving state of the vehicle, and a function to form a pattern image that represent various information on the road surface around the vehicle. The vehicle lamp 1 of the present disclosure may be used for a single function among the above-mentioned functions, or may be used for two or more functions.

Hereinafter, in an exemplary embodiment of the present disclosure, an example where the vehicle lamp 1 of the present disclosure is used for a function to form a pattern image on the road surface around the vehicle is described. However, the present disclosure is not limited thereto, and it may be similarly applied where the vehicle lamp 1 is used for an illumination function or a signaling function.

In this case, the pattern image formed on the road surface around the vehicle may be understood as an image that facilitates a nearby vehicle or pedestrian to more easily recognize the driving state of the vehicle and respond thereto, such as a reverse movement or a turn direction of the vehicle.

The light source unit 100 may include a light source 110 and a light transferring unit 120. The light source 110 may generate light having a light amount and/or color suitable for the use of the vehicle lamp 1 of the present disclosure. In an exemplary embodiment of the present disclosure, the light source 110 may include at least one semiconductor light emitting device, such as a light emitting diode (LED), but the present disclosure is not limited thereto. Various types of light sources such as a bulb or Laser Diode (LD) in addition to the semiconductor light emitting device may be used as the light source 110. Depending on the type of the light source 110, an optical element such as a lens, a mirror, a prism, and a reflector that affect the properties of light such as the path and/or brightness of the light generated from the light source 110 may be additionally used.

The light transferring unit 120 may transfer the light generated from the light source 110 to the lens unit 200 disposed in front of the light source unit 100. More specifically, the expression that the lens unit 200 is disposed in front of the light source unit 100 is based on an exemplary configuration where the direction, in which the light is irradiated from the vehicle lamp 1 of the present disclosure, is the front, and the absolute direction may vary depending on the installation position or direction of the vehicle lamp 1 of the present disclosure with respect to the vehicle.

Figure 4:
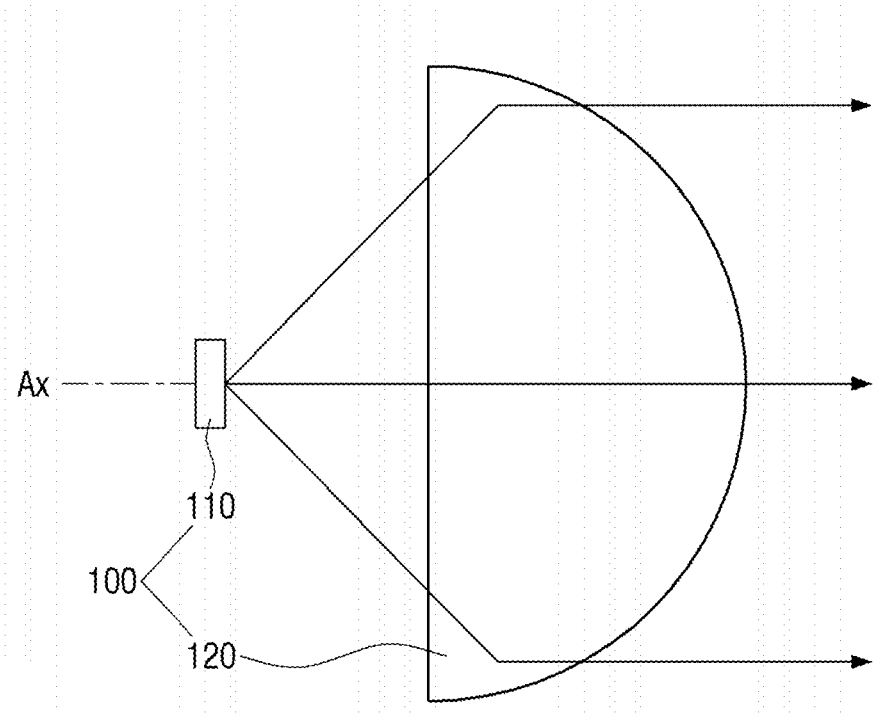
FIG. 4 is a schematic diagram illustrating an optical path of a light transferring unit according to an exemplary embodiment of the present disclosure.

FIG. 4 is a schematic diagram illustrating an optical path of a light transferring unit according to an exemplary embodiment of the present disclosure. Referring to FIG. 4, the light transferring unit 120 according to an exemplary embodiment of the present disclosure may convert the light generated from the light source 110 into substantially parallel light that is parallel to the optical axis Ax of the light source 110. In the exemplary embodiment of the present disclosure, an aspherical lens may be used as the light transferring unit 120, but the present disclosure is not limited thereto. Various types of optical elements such as Total Internal Reflection (TIR) lenses, Fresnel lenses, reflectors, and the like may be used.

In the exemplary embodiment of the present disclosure, an example where the light generated from the light source 110 is converted by the light transferring unit 120 into parallel light that is parallel to the optical axis Ax of the light source 110 is described. However, the present disclosure is not limited thereto, and the light converted by the light transferring unit 120 may not be parallel to the optical axis Ax of the light source 110 depending on the shape of the light transferring unit 120 or the position of the lens unit 200. The conversion of the light generated from the light source 110 into the parallel light by the light transferring unit 120 may allow the light generated from the light source 110 to be incident on the entire lens unit 200 substantially uniformly.

Figure 5:
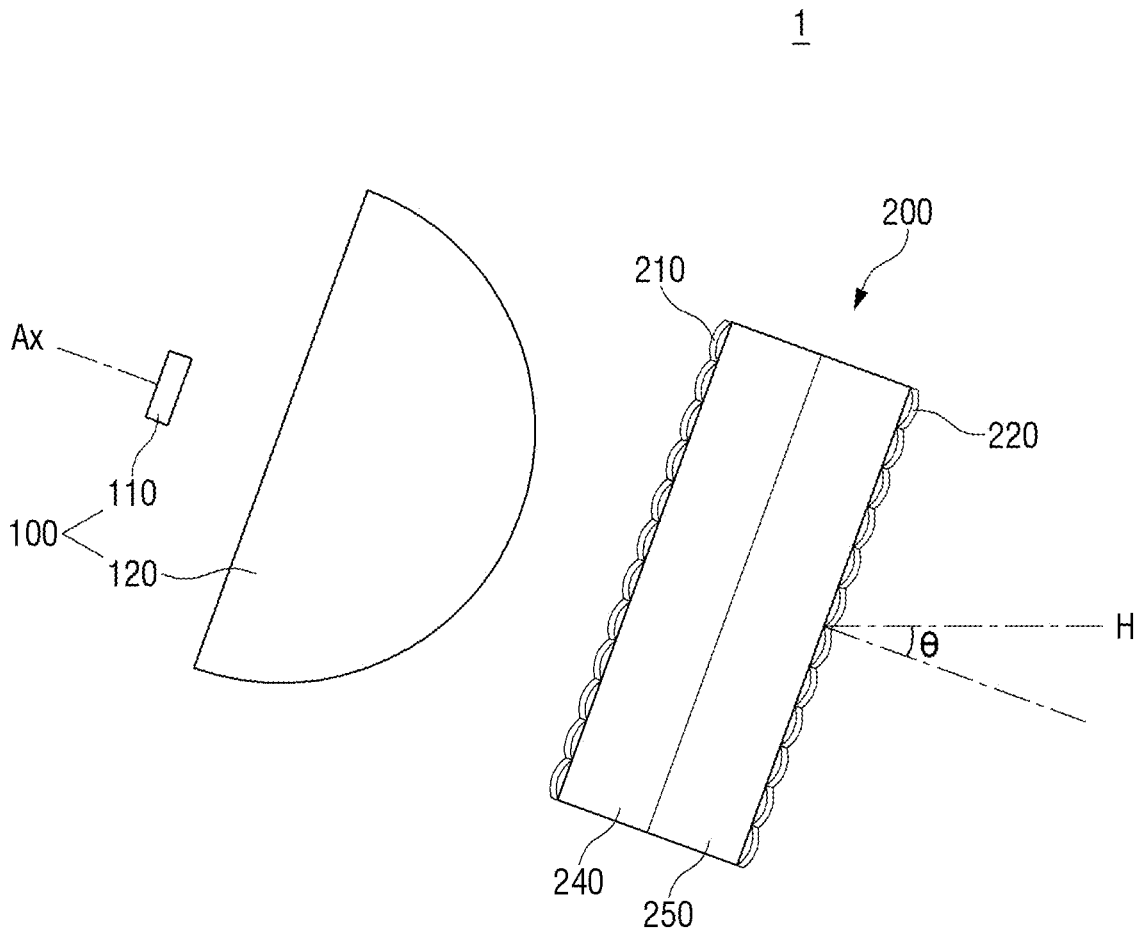
FIG. 5 is a schematic diagram showing an installation angle of a vehicle lamp according to an exemplary embodiment of the present disclosure.

The lens unit 200 may form a pattern image by allowing the light incident from the light source unit 100 to be irradiated to the road surface around the vehicle. To this end, the lens unit 200 may be inclined to have a predetermined angle θ in a forward-downward direction with respect to the horizontal direction H as it goes from the light source unit 100 toward the lens unit 200, as shown in FIG. 5.

Figure 6:
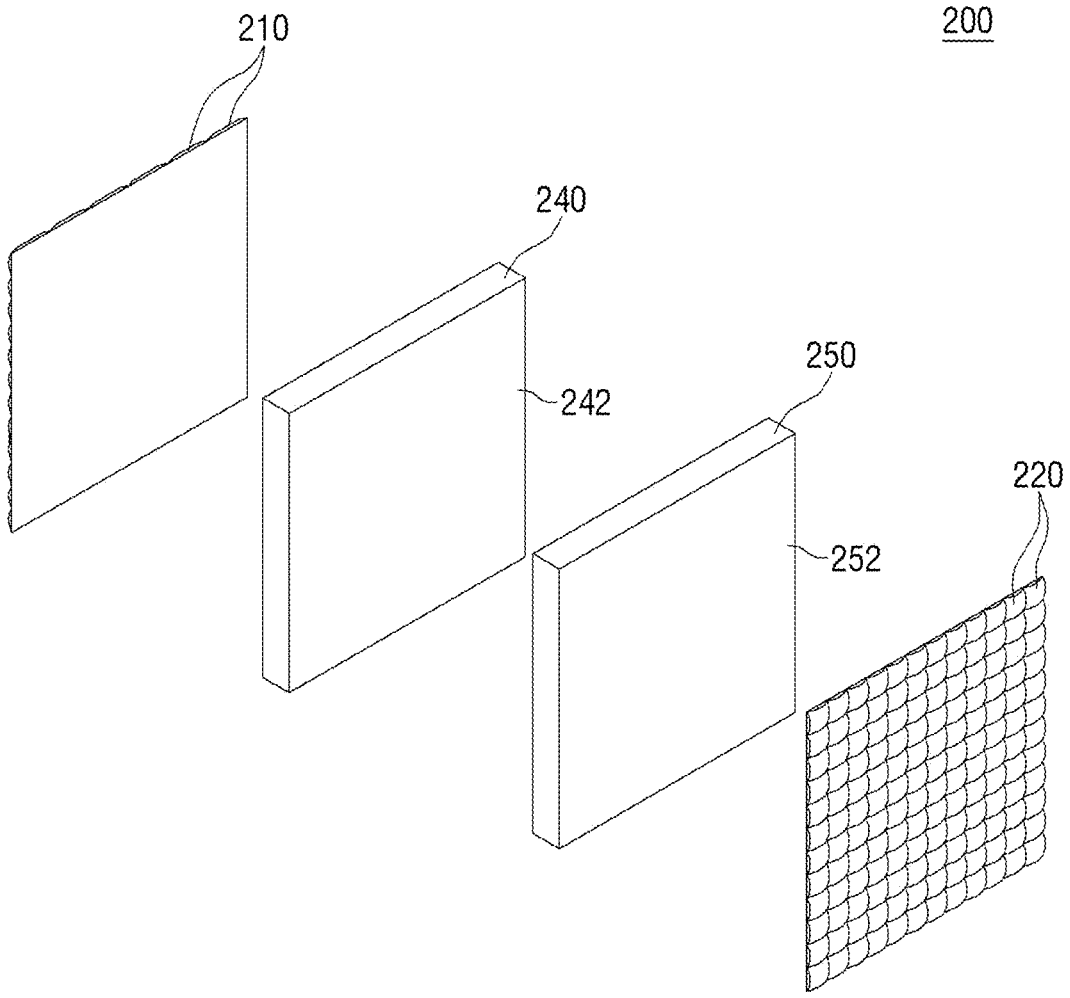
FIGS. 6 and 7 are exploded perspective views showing a lens unit according to an exemplary embodiment of the present disclosure.
Figure 7:
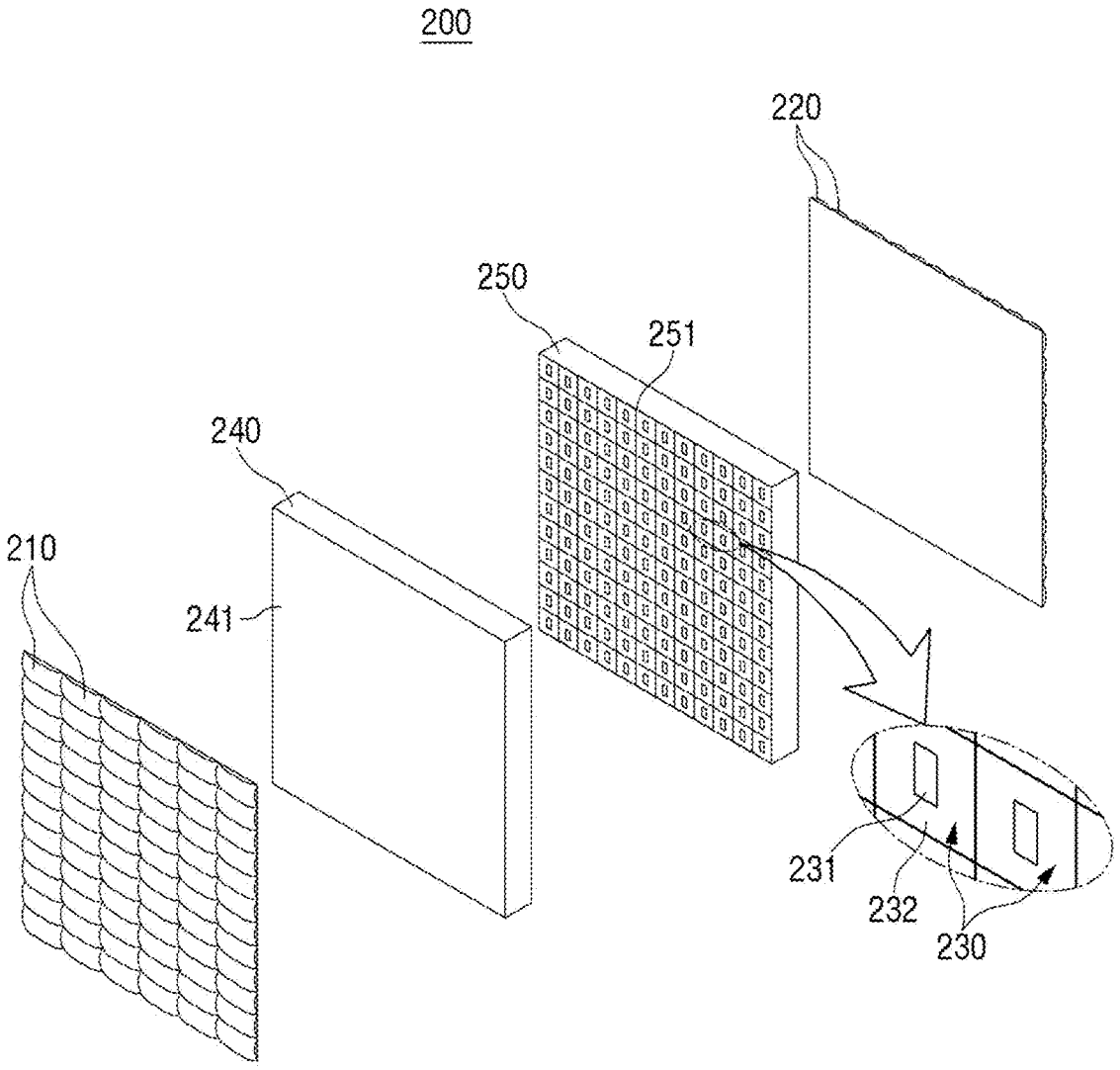
Figure 8:
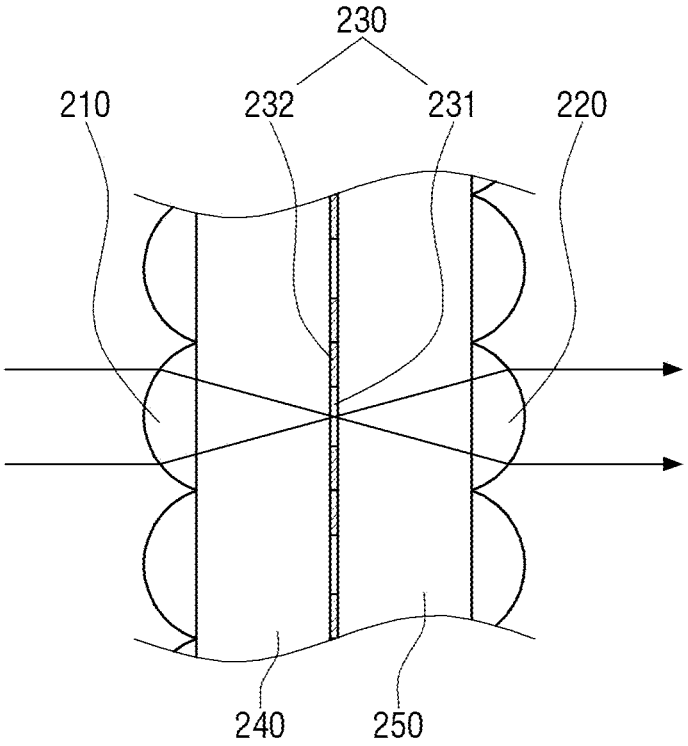
FIG. 8 is a schematic diagram illustrating an optical path of a lens unit according to an exemplary embodiment of the present disclosure.

FIGS. 6 and 7 are exploded perspective views illustrating a lens unit according to an exemplary embodiment of the present disclosure, and FIG. 8 is a schematic diagram illustrating an optical path of the lens unit according to an exemplary embodiment of the present disclosure.

Referring to FIGS. 6 to 8, the lens unit 200 according to an exemplary embodiment of the present disclosure may include a plurality of incident lenses 210, a plurality of emitting lenses 220, and a plurality of shields 230.

The plurality of incident lenses 210 may receive the light generated from the light source unit 100, and the plurality of emitting lenses 220 may allow at least a portion of the light incident to a corresponding incident lens among the plurality of incident lenses 210 to be emitted, so that it may form a pattern image on the road surface around the vehicle. It may be understood that the pattern image formed by the vehicle lamp 1 of the present disclosure is formed collectively by combining pattern images formed by each of the plurality of emitting lenses 220. In this case, a micro lens having a relatively short focal length may be used for miniaturization of the plurality of incident lenses 210 and the plurality of emitting lenses 220.

In the exemplary embodiment of the present disclosure, each of the plurality of incident lenses 210 may include a semi-cylindrical shape elongated in the left-right direction, and the light incident to any one of the plurality of incident lenses 210 may be emitted through a plurality of emitting lenses disposed in the left-right direction among the plurality of emitting lenses 220. However, this configuration is only an example to help the understanding of the present disclosure, and the present disclosure is not limited thereto. A plurality of incident lenses 210 and a plurality of emitting lenses 220 may correspond to each other in one-to-one, one-to-many, many-to-one, many-to-many, and the like depending on the size, shape, brightness, etc. of the pattern image formed by the vehicle lamp 1 of the present disclosure. Examples of the plurality of incident lenses 210 and the plurality of emitting lenses 220 corresponding one-to-one, one-to-many, many-to-one, or many-to-many can be found in U.S. Patent Application Publication No. 2019/0186706, which is incorporated herein by reference in its entirety.

The plurality of incident lenses 210 may be disposed on an incident surface 241 of a first optical member 240, and the plurality of emitting lenses 220 may be disposed on an emitting surface 252 of a second optical member 250 disposed in front of the first optical member 240, and in this case, the emitting surface 242 of the first optical member 240 and the incidence surface 251 of the second optical member 250 may be disposed to face each other. By way of example, the first optical member 240 and the second optical member 250 may include a material such as glass, through which light can be transmitted, so that the light incident on the plurality of incident lenses 210 may be emitted through the plurality of emitting lenses 220.

In addition, in the exemplary embodiment of the present disclosure, an example where the first optical member 240 and the second optical member 250 are separately manufactured is described. However, the present disclosure is not limited thereto, and the first optical member 240 and the second optical member 250 may be integrally manufactured.

The plurality of shields 230 may be formed in at least one of the first optical member 240 or the second optical member 250 to obstruct at least a portion of the light that proceeds to the plurality of emitting lenses 220. In the exemplary embodiment of the present disclosure, the plurality of shields 230 may be formed on the incident surface 251 of the second optical member 250 by deposition or coating, but the present disclosure is not limited thereto. The plurality of shields 230 may be formed on one surface of at least one of the first optical member 240 or the second optical member 250 depending on a focal position between the corresponding incident and emitting lenses among the plurality of incident lenses 210 and the plurality of emitting lenses 220.

In addition, in the exemplary embodiment of the present disclosure, an example where a single shield is disposed between an incident lens and an emitting lens corresponding to each other among the plurality of incident lenses 210 and the plurality of emitting lenses 220 is described. However, the present disclosure is not limited thereto, and two or more shields may be disposed between an incident lens and an emitting lens corresponding to each other, depending on the size, shape, brightness, etc. of the pattern image to be formed by the vehicle lamp 1 of the present disclosure.

Each of the plurality of shields 230 may include a transmission region 231 for transmitting light and a blocking region 232 for obstructing light, and depending on the size and/or shape of the transmission region 231, the size and/or shape of the pattern image formed on the road surface around the vehicle by the vehicle lamp 1 of the present disclosure may be varied.

In particular, among the light that transmits through the transmission region 231, portions of the light transmitting through different positions of the transmission region 231 may be irradiated at different distances from the vehicle, and in this case, a gradation effect, in which a part of the pattern image formed by a vehicle lamp 1 of the present disclosure has a different brightness from other parts, can be implemented.

For example, while the amount of light transmitting through the transmission region 231 is uniform, the light transmitting through a position closer to an upper end of the transmission region 231 and the light transmitting through a position closer to a lower end of the transmission region 231 may be radiated to different distances from the vehicle, thereby causing a gradation effect in the pattern image.

Meanwhile, since the light transmitting through different positions of the transmission region 231 in the left-right directions is irradiated at approximately the same distance from the vehicle, it is more difficult to implement a gradation effect along the left-right direction.

Therefore, in order to implement a gradation effect in various directions such as the left-right direction, the diagonal direction, etc. as well as the up-down direction, a portion of the light that proceeds through the transmission region 231 may be obstructed so that the pattern image formed by the vehicle lamp 1 of the present disclosure may have various brightness patterns.

Figure 9:
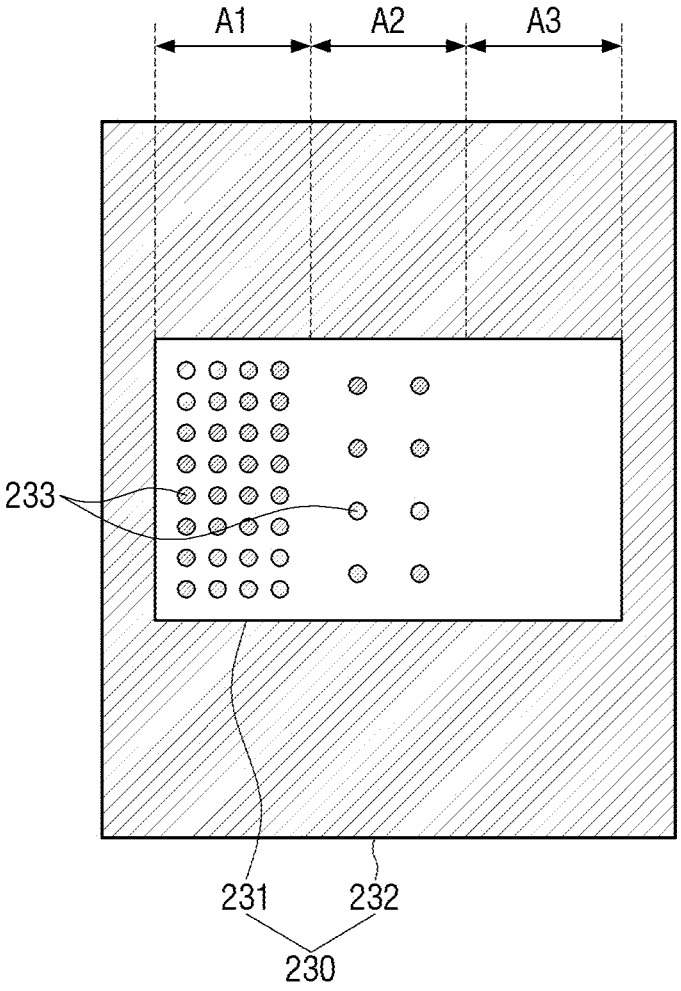
FIG. 9 is a schematic diagram illustrating a shield according to an exemplary embodiment of the present disclosure.
Figure 10:
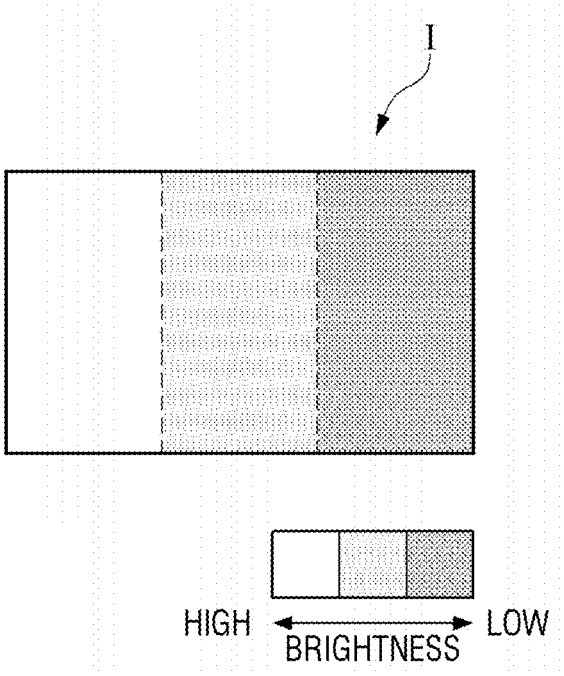
FIG. 10 is a schematic diagram showing a pattern image formed by the shield of FIG. 9.

FIG. 9 is a schematic diagram showing a shield according to an exemplary embodiment of the present disclosure, and FIG. 10 is a schematic diagram showing a pattern image formed by the shield of FIG. 9, which shows one of the plurality of shields 230. Similar description may be applied to the remaining shields only with some differences in the formation positions.

Referring to FIG. 9, the transmission region 231 of the shield 230 may be divided into three regions A1, A2, and A3 in the left-right direction, and it can be seen that the distribution density, with which light shielding members 233 are formed, may decrease from left to right. In the exemplary embodiment of the present disclosure, the division of the transmission region 231 of the shield 230 into three regions A1, A2, and A3 is merely an example to help the understanding of the present disclosure, and the transmission region 231 of the shield 230 may be divided into at least two regions.

As described above, when the distribution density of the light shielding members 233 increases or decreases from one side of the transmission region 231 to the other side thereof in the left-right direction, as shown in FIG. 10, a gradation effect, in which the brightness is gradually increased or decreased from one side to the other side in the left-right direction, can be implemented in the pattern image I, which is formed by the vehicle lamp 1 of the present disclosure.

Referring to FIGS. 9 and 10, the distribution density may be greater at the region disposed on the left side of the transmission region 231, as shown in FIG. 9, and the brightness may be lower at the region disposed on the right side, as shown in FIG. 10. This is because the pattern image I formed by the light emitted through the plurality of emitting lenses 220 may appear in a reverse image when an aspherical lens is used as the plurality of emitting lenses 220. However, the present disclosure is not limited thereto, and a position to which light transmitting through an arbitrary position in the transmission region 231 is irradiated may vary depending on a shape or a curvature of the plurality of incident lenses 210 and the plurality of emitting lenses 220.

The non-uniform distribution densities of the light shielding members 233 may be understood as that the distances between adjacent light shielding members 233 are different, and/or that the number of the light shielding members 233 formed in a region of the same size are different.

In addition, high or low distribution density may include not only a case where the number of light shielding members 233 formed in the same size region is large or small, but also a case where no light shielding member is formed (i.e., zero distribution density).

In addition, in the exemplary embodiment of the present disclosure, the light shielding members 233 are depicted as a circular shape. However, this is only an example to help the understanding of the present disclosure, and the light shielding members 233 may have a circular shape, as well as an ellipse, a polygon, or a combination thereof, depending on the brightness of the pattern image I to be formed by the vehicle lamp 1 of the present disclosure.

As described above, due to the distribution density of the light shielding members 233 changing from one side of the transmission region 231 to the other side thereof in the left-right direction, even if the distance, to which the light is irradiated from the vehicle, is the same, a natural gradation effect can be implemented in the left-right direction.

Figure 11:
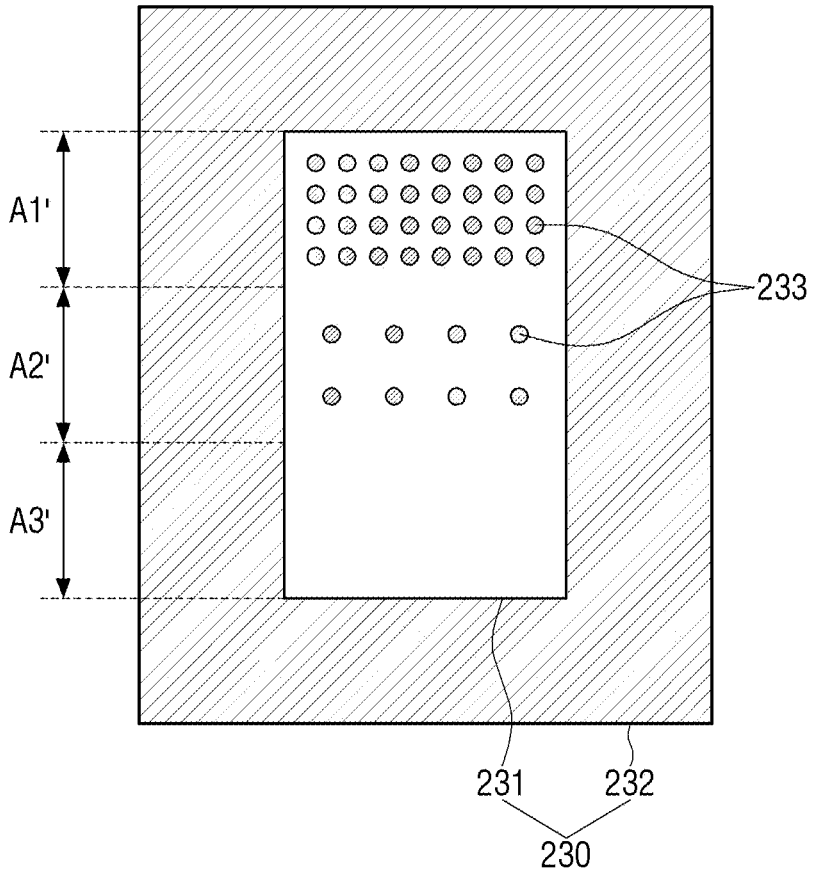
FIG. 11 is a schematic diagram showing a shield according to another exemplary embodiment of the present disclosure.
Figure 12:
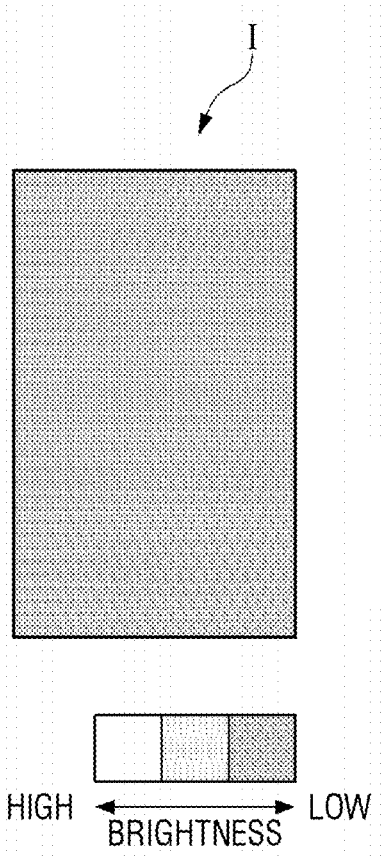
FIG. 12 is a schematic diagram showing a pattern image formed by the shield of FIG. 11.

FIG. 11 is a schematic diagram illustrating a shield according to another exemplary embodiment of the present disclosure, and FIG. 12 is a schematic diagram illustrating a pattern image formed by the shield of FIG. 11. Referring to FIG. 11, the transmission region 231 of the shield 230 may be divided into three regions A1', A2', and A3' in the up-down direction, and it can be seen that the distribution density of the light shielding member 233 is greater at the upper side.

In the another exemplary embodiment of the present disclosure, the division of the transmission region 231 of the shield 230 into three regions A1', A2', and A3' is only an example for helping understanding of the present disclosure, and the transmission region 231 of the shield 230 may be divided into at least two regions depending on the brightness pattern.

With this configuration, even though the distribution densities of the light shielding members 233 in the up-down direction are non-uniform as shown in FIG. 11, a pattern image I may be formed with a substantially uniform brightness as shown in FIG. 12. This is because the light transmitting through a position closer to the upper end of the transmission region 231 is to be irradiated closer to the vehicle, and the light transmitting through a position closer to the lower end of the transmission region 231 is to be irradiated to a greater distance from the vehicle. Therefore, the amount of light transmitting through the position closer to the upper end of the transmission region 231 may be reduced, allowing the overall brightness to be more uniform.

In another exemplary embodiment of the present disclosure, the configuration that the light transmitting through the upper region of the transmission region 231 is irradiated closer to the vehicle is merely an example for helping understanding of the present disclosure, but the present disclosure is not limited thereto. A position, to which the light transmitting through an arbitrary position in the transmission region 231 is irradiated, may vary depending on the shape or curvature of the plurality of incident lenses 210 and the plurality of emitting lenses 220.

In the above described exemplary embodiment, the cases in which the distribution density of the light shielding members 233 is changed in the left-right direction and the up-down direction are separately described. However, the present disclosure is not limited thereto, and the light shielding members 233 may be formed such that the distribution density is changed in a left-right direction, an up-down direction, or a combination thereof, depending on the brightness pattern of the pattern image I to be formed by the vehicle lamp 1 of the present disclosure.

Figure 13:
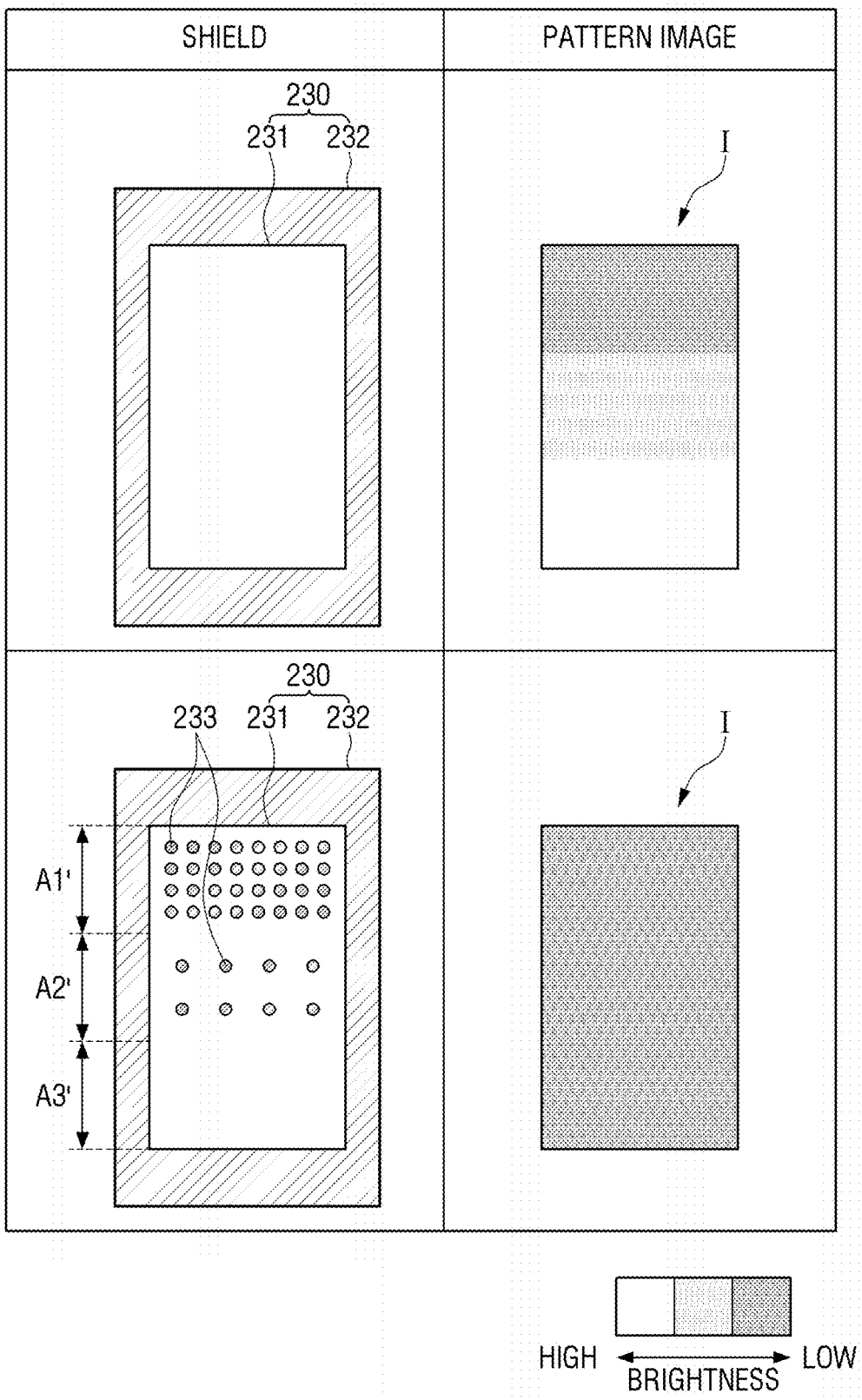
FIG. 13 compares pattern images depending on the presence of light shielding members according to an exemplary embodiment of the present disclosure.

FIG. 13 illustrates pattern images with (top) and without (bottom) the presence of the light shielding members. Referring to FIG. 13, when no light shielding member is formed in the transmission region 231 of the shield 230, since the light transmitting through the lower region of the transmission region 231 is irradiated to a greater distance from the vehicle and the brightness becomes relatively lower, the brightness of the pattern image I relatively decreases as the distance from the vehicle increases. However, when the distribution density of the light shielding members 233 decreases from the upper region to the lower region within the transmission region 231, the amount of light irradiated to a closer distance from the vehicle is relatively reduced so that the pattern image I may be formed with a more uniform brightness as a whole may be formed.

As such, in the exemplary embodiment of the present disclosure, the pattern image may have a gradation in at least one direction or may have a substantially uniform brightness based on the distance to which the light is irradiated from the vehicle and the distribution density of the light shielding member 233. Therefore, a pattern image having a desired brightness pattern may be more easily formed without adjusting the amount of light generated from the light source unit 100 depending on the shape or brightness of the pattern image, or adding a separate optical system for forming pattern images with various configurations of brightness.

In the above described exemplary embodiments, cases where a single transmission region 231 is formed in the shield 230 is described as an example. However, the present disclosure is not limited thereto, and two or more transmission regions may be formed in the shield 230. Even in this case, a pattern image having a desired brightness pattern may be formed by adjusting the distribution density of the light shielding members formed in each transmission region.

Figure 14:
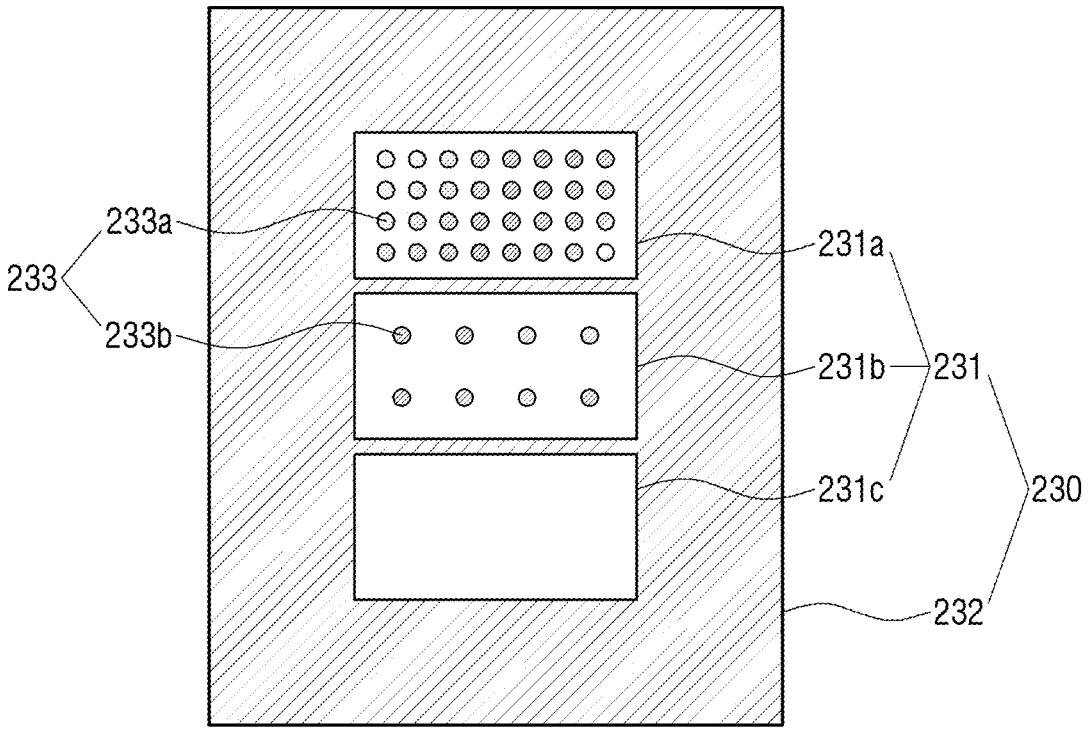
FIG. 14 is a schematic diagram showing a shield according to another exemplary embodiment of the present disclosure.
Figure 15:
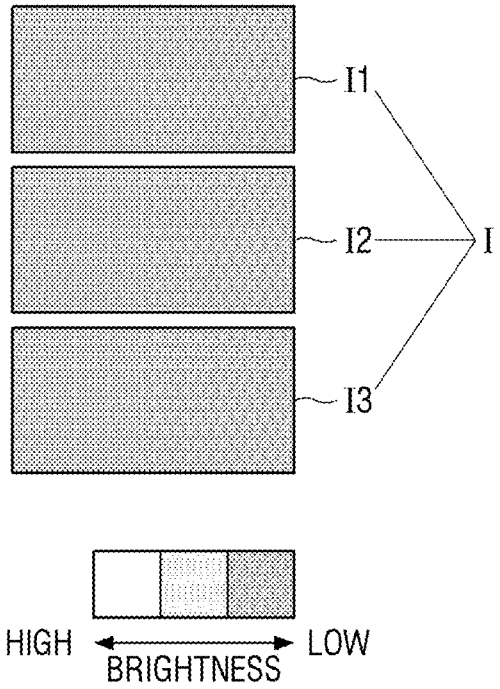
FIG. 15 is a schematic view showing a pattern image formed by the shield of FIG. 14.

FIG. 14 is a schematic diagram illustrating a shield according to another exemplary embodiment of the present disclosure, and FIG. 15 is a schematic diagram illustrating a pattern image formed by the shield of FIG. 14. Referring to FIG. 14, the transmission region 231 of the shield 230 may include a plurality of sub transmission regions 231*a*, 231*b*, and 231*c*. The light shielding members 233*a* and 233*b* with different distribution densities may be formed in the sub transmission regions 231*a* and 231*b*, respectively, except for the sub transmission region 231*c*, through which the light is irradiated to the farthest distance, among the plurality of sub transmission regions 231*a*, 231*b*, and 231*c*. Accordingly, the pattern image I formed by the vehicle lamp 1 of the present disclosure may include sub pattern images I1, I2, and I3 formed by the plurality of sub transmission regions 231*a*, 231*b*, and 231*c*, respectively, having substantially uniform brightness between them.

In FIG. 15, an example where the plurality of sub pattern images I1, I2, and I3 have uniform brightness is described, but the present disclosure is not limited thereto. One or more of the plurality of sub pattern images I1, I2, and I3 may be formed to have a different brightness from others based on the distribution density of the light shielding members formed in each of the plurality of sub transmission regions 231*a*, 231*b*, and 231*c* so that a gradation effect can be implemented or a gradation effect can be implemented within each of the plurality of sub pattern images I1, I2, and I3.

Meanwhile, the above-described light shielding members 233 may be formed in a shield disposed in at least a region corresponding to the central region of the lens unit 200 among the plurality of shields 230. This is because the closer to the center of the lens unit 200, in other words, the closer to the optical axis Ax of the light source 110, the greater the amount of light is produced, and thus the greater the impact on the brightness of the pattern image I becomes. Therefore, the gradation may be implemented more effectively.

Accordingly, the lens unit 200 may be divided into a central region and a peripheral region around the central region, and the light shielding members 233 may be formed on all of the plurality of shields 230 or may be formed in the shields included in the region corresponding to the central region of the lens unit 200 among the plurality of shields 230.

As described above, by adjusting the distribution density of the light shielding members 233 formed in the transmission region 231 of each of the plurality of shields 230, the brightness pattern of the pattern image I may be more easily adjusted without adding a separate optical system or adjusting the light amount of the light source 110 depending on the brightness pattern of the pattern image I.

In concluding the detailed description, those skilled in the art will appreciate that many variations and modifications can be made to the exemplary embodiments without substantially departing from the principles of the present disclosure. Therefore, the disclosed exemplary embodiments of the disclosure are used in a generic and descriptive sense only and not for purposes of limitation.

What is claimed is:

1. A lamp for a vehicle comprising:

a light source unit for generating light; and a lens unit including a plurality of incident lenses, to which the light generated from the light source unit is incident, a plurality of emitting lenses for emitting the light incident from the plurality of incident lenses, and a plurality of shields for obstructing at least a portion of the light incident to each of the plurality of emitting lenses, wherein each of the plurality of shields includes a transmission region for transmitting light and a blocking region for obstructing light, wherein at least one light shielding member for obstructing a portion of the light through the transmission region is formed in the transmission region of at least one of the plurality of shields, wherein the at least one light shielding member comprises a plurality of light shielding members formed in the transmission region, and wherein a distribution density of the plurality of light shielding members within the transmission region increases going from a first edge to a second edge of the transmission region.

2. The lamp for a vehicle of claim 1, wherein the light source unit comprises:

at least one light source; and a light transferring unit for converting the light generated from the at least one light source into substantially parallel light and transferring it to the lens unit.

3. The lamp for a vehicle of claim 1, wherein the lens unit further comprises:

a first optical member, wherein the plurality of incident lenses are formed on an incident surface thereof; and a second optical member, wherein the plurality of emitting lenses are formed on an emitting surface thereof, and wherein the plurality of shields are formed in at least one of the first optical member or the second optical member.

4. The lamp for a vehicle of claim 1, wherein the plurality of light shielding members are formed to have non-uniform distribution densities across the transmission region.

5. The lamp for a vehicle of claim 1, wherein the lens unit is divided into a central region and a peripheral region around the central region, and wherein the at least one light shielding member is formed in a shield disposed in a region corresponding to the central region of the lens unit among the plurality of shields.

6. The lamp for a vehicle of claim 1, wherein the at least one light shielding member decreases amount of light that transmits through at least some region of the transmission region to allow different regions of a pattern image formed on a road surface around the vehicle to exhibit different brightness by light transmitting through the transmission region.

7. The lamp for a vehicle of claim 1, wherein the at least one light shielding member decreases amount of light that transmits through at least some region of the transmission region to allow a pattern image formed on a road surface around the vehicle to exhibit substantially uniform brightness by light transmitting through the transmission region.

8. The lamp for a vehicle of claim 1, wherein the transmission region comprises a plurality of sub transmission regions, and wherein the at least one light shielding member formed in at least one of the plurality of sub transmission regions has a different distribution density from other light shielding members formed in other sub transmission regions.

9. The lamp for a vehicle of claim 1, wherein the transmission region comprises a plurality of sub transmission regions, and wherein the at least one light shielding member formed in at least one sub transmission region among the plurality of sub transmission regions has non-uniform distribution densities across the at least one sub transmission region.

10. A lamp for a vehicle comprising:

a light source unit for generating light; and a lens unit including a plurality of incident lenses, to which the light generated from the light source unit is incident, a plurality of emitting lenses for emitting the light incident from the plurality of incident lenses, and a plurality of shields for obstructing at least a portion of the light incident to each of the plurality of emitting lenses, wherein each of the plurality of shields includes a transmission region for transmitting light and a blocking region for obstructing light, wherein a plurality of light shielding members for obstructing a portion of the light through the transmission region are formed in the transmission region of at least one of the plurality of shields, and wherein the plurality of light shielding members formed in at least one of the plurality of shields have a distribution density that is different from a distribution density of the plurality of light shielding members formed in at least one other of the plurality of shields.

* * * * *